US006534987B2

(12) United States Patent
Fukuda

(10) Patent No.: US 6,534,987 B2
(45) Date of Patent: Mar. 18, 2003

(54) MAGNETO-SYSTEM FIRING APPARATUS

(75) Inventor: Daiki Fukuda, Fuji (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 34 days.

(21) Appl. No.: 09/795,457

(22) Filed: Mar. 1, 2001

(65) Prior Publication Data

US 2002/0121899 A1 Sep. 5, 2002

(51) Int. Cl.[7] ..... E02P 17/00; F02P 1/00
(52) U.S. Cl. ..... 324/389; 123/599
(58) Field of Search ..... 324/389, 380, 324/378, 381, 385, 388, 398; 123/599, 651

(56) References Cited

U.S. PATENT DOCUMENTS 6,279,558 B1 * 8/2001 Fukuda ..... 123/599

FOREIGN PATENT DOCUMENTS

| | | |
|---|---|---|
| JP | A 6-307318 | 11/1994 |
| JP | A 10-184510 | 7/1998 |
| JP | A 2000-213443 | 8/2000 |

* cited by examiner

*Primary Examiner*—N. Le
*Assistant Examiner*—James Kerveros
(74) *Attorney, Agent, or Firm*—Oliff & Berridge, PLC

(57) ABSTRACT

A magneto-system firing apparatus which is capable of rapidly detecting an abnormal state in the case where abnormality occurs in the make/break operation of a contact point due to damage of a breaker or the like. A magneto-system firing apparatus includes a magnet fixed to a rotary shaft that interlocks with a crank shaft of an engine; a primary coil to which a low-voltage current that is generated due to the rotation of the magnet is supplied; a breaker which is connected to the primary coil and interrupts the low-voltage current supplied to the primary coil by its break operation; a secondary coil in which a predetermined voltage is induced due to the current interruption caused by the break operation of the breaker to actuate the firing apparatus by application of the voltage generated in the secondary coil; a crank angle detecting portion for detecting the rotating angle of the crank shaft; a breaker make/break state detecting portion for detecting the make/break state of the breaker; and a breaker failure detecting device having a breaker make/break abnormality detecting portion which is capable of detecting the abnormal state of the breaker make/break operation on the basis of information from the crank angle detecting portion and the breaker make/break state detecting portion.

10 Claims, 7 Drawing Sheets

MAGNETO-SYSTEM FIRING APPARATUS

BACKGROUND OF THE INVENTION

1. Field of the Invention

The present invention relates to a magneto-system firing apparatus, and more particularly to a magneto-system firing apparatus mounted on an aircraft and having a breaker failure detecting portion which is capable of detecting an abnormal state of the make/break operation of the breaker.

2. Description of the Related Art

In general, a battery type firing apparatus is applied to an engine for an automobile, but a self-generatable magneto-system firing apparatus is used in the aircraft from the viewpoint of safety.

As shown in FIG. 8, the magneto-system firing apparatus of this type includes a permanent magnet 11 disposed on a rotary shaft 10 that interlocks with a crank shaft of an engine, a primary coil 13 that forms an ignition coil wound around an iron core 12 which is so disposed as to surround the permanent magnet 11, a secondary coil 14 larger in turn ratio than the primary coil 13, a cam mechanism 15 connected to the primary coil 13 and disposed on the rotary shaft 10, and a mechanical breaker 18 which is driven by the cam mechanism 15, and makes intermittent a current generated in the primary coil 13 due to the make/break operation of a contact point 17 which is abutted against the surface of the cam 16 or spaced apart from the cam 16.

In the magneto-system firing apparatus 19 of this type, in the case where a low-voltage current is generated as an inductance current in the primary coil 13 due to the rotation of the permanent magnet 11 interlocked with the rotation of the crank shaft, the breaker 18 is driven by the cam mechanism 15 so as to be actuated so that the contact point 17 is opened, and the low-voltage current in the primary coil 13 is broken, as a result of which a high-voltage current is induced in the secondary coil 14, and the high voltage is applied to spark plugs (not shown) disposed in the respective cylinders through a distributor 20 to cause spark discharge at spark gaps and fire an air-fuel mixture in the cylinders, thereby driving pistons. In the figure, reference numeral 21 denotes a capacitor and 22 is a spark plug.

In the breaker 18 thus structured, since the above contact point 17 is repeatedly physically abutted against and spaced apart from the surface of the cam 16 to make and break the current that flows in the primary coil 13, there is a possibility that the contact point 17 is burned and damaged while it is used. In the case where the contact point 17 is thus burned and damaged, even if the crank reaches a predetermined rotating angle at a spark timing, the breaker 18 does not appropriately conduct the make/break operation, so that the current in the primary coil 13 is not broken, with the results that because the high-voltage current is not induced in the secondary coil 14, there is a case in which the spark discharge does not occur in the spark plug, and the air-fuel mixture within the cylinder is not fired.

In order to prevent the above situation, in an engine for an aircraft, there is formed a so-called dual ignition system having two magneto-system firing apparatuses 19 for each of the piston cylinders from the viewpoint of safety. A pilot is under an obligation to conduct the stop operation with respect to the two magneto-system firing apparatuses 19 mounted on the respective cylinders, to confirm that the number of revolutions of an engine is lowered a certain degree, and to confirm whether or not the respective magneto-system firing apparatuses 19 are normally actuated, before every time the aircraft takes off. The above confirming operation must be conducted every time before flying which is troublesome.

Also, at the time of inspections on the ground, the operation of inspecting the breakers is periodically conducted every several tens hours, and in the case where the contact point 17 is burned and damaged, it is necessary to replace the breaker 18 with a new one. Thus, the inspecting and maintaining operation is also complicated. Under the above circumstances, up to now, it is desirable to provide a means for detecting the burning damage and deterioration of the breaker 18 of the magneto-system firing apparatus 19 at a real time.

However, it is difficult to provide the means for detecting the abnormal operation of the breaker 18 for the following reasons.

In order to judge whether or not the contact point 17 of the breaker 18 is normally actuated, there is proposed, for example, a manner in which a circuit that can detect the resistance value of the breaker 18 is disposed in the breaker 18, and the respective resistance values at the make/break time of the contact point 17 are measured, and whether or not the contact point 17 is appropriately made and broken, is judged on the basis of a change in the resistance value.

In this case, the primary coil 13 of the ignition coil is connected in parallel with the breaker 18, and the impedance of the primary coil 13 is about 0.65 to 0.7 Ω. Since the breaker 18 is influenced by the impedance when the breaker 18 is made, the resistance value detected on the breaker 18 when the breaker 18 is broken becomes about 0.65 to 0.7 Ω, likewise.

On the other hand, when the breaker 18 is made, the resistance value of the breaker 18 is 0 Ω, but since a difference in the resistance between the make and break states is slight, it is difficult to distinguish the make state from the break state, and to judge whether or not the make/break operation is appropriately conducted.

Also, as described above, when the breaker 18 is broken, the low-voltage current in the primary coil 13 is interrupted with the result that a large serge voltage is generated in the secondary coil 14. Therefore, in the case where a detecting circuit and an electronic parts for detection are connected to the breaker 18, since the detecting circuit and the electronic parts cannot withstand the serve voltage, it is difficult to connect the detecting circuit and the electronic parts for detection to the breaker 18.

SUMMARY OF THE INVENTION

An object of the present invention is to provide a magneto-system firing apparatus which is capable of detecting an abnormal state rapidly in the case where the breaker is damaged or the like, and there occurs abnormality in the make/break operation of the contact point.

Also, another object of the present invention is to provide a magneto-system firing apparatus that detects the abnormality of the make/break operation on the basis of information related to an angle of a crank shaft of an engine and information related to the make/break operation of the breaker.

In order to achieve the above objects, there is provided a magneto-system firing apparatus, comprising: a magnet fixed to a rotary shaft that interlocks with a crank shaft of an engine; a primary coil to which a low-voltage current that is generated due to the rotation of the magnet is supplied; a breaker which is connected to the primary coil and interrupts the low-voltage current supplied to the primary coil by its break operation; a secondary coil in which a predetermined voltage is induced due to the current interruption caused by the break operation of the breaker to actuate the firing apparatus by application of the voltage generated in the secondary coil; a crank angle detecting portion for detecting the rotating angle of the crank shaft; a breaker make/break state detecting portion for detecting the make/break state of the breaker; and a breaker failure detecting device having a breaker make/break abnormality detecting portion which is capable of detecting the abnormal state of the breaker make/break operation on the basis of information from the crank angle detecting portion and the breaker make/break state detecting portion.

Accordingly, in the present invention, the breaker make/break abnormality detecting portion conducts judgment on the basis of information related to the crank angle outputted from the crank angle detecting portion and information related to the breaker make/break state outputted from the breaker make/break state detecting portion and detects the abnormal state in a case the breaker make/break state is abnormal. As a result, if abnormality occurs in the make/break state of the breaker, the abnormality can be rapidly recognized.

Accordingly, in the case where the magneto-system firing apparatus according to the present invention is employed in an aircraft, if abnormality occurs in the make/break state of the breaker, a pilot can recognize the abnormal state. As a result, since the pilot can recognize the abnormal state of the breaker at a real time, although it is necessary to periodically conduct the inspecting operation of the breaker every 20 hours at the time of inspection on the ground up to now, it is unnecessary to always periodically conduct the inspecting operation in a short period, and the period of the inspecting operation can be lengthened, and the number of times of complicated inspecting operation can be lessened.

Also, according to a second aspect of the present invention, abridge circuit is connected between the primary coil and the breaker, and the breaker is connected with the breaker failure detecting device through a serge voltage preventing means for preventing a serge voltage generated in the primary coil. Also, the crank angle detecting portion includes a magnetic portion disposed on the rotary shaft, a sensor that detects the magnetic portion, and a crank angle detecting means for outputting an electric signal resulting from detecting the magnetic portion by the sensor as an electric signal that represents the rotating angle of the crank. The breaker make/break state detecting portion is so structured as to output the make/break state of the breaker as an electric signal, and the breaker make/break abnormality detecting portion is so structured as to output a predetermined electric signal on the basis of the electric signals outputted from the crank angle detecting portion and the breaker make/break state detecting portion if the make/break operation of the breaker is abnormal.

Accordingly, in the second aspect of the present invention, since the bridge circuit is connected between the primary coil and the breaker, an influence of the impedance of the primary coil to the beaker can be removed. Therefore, since the resistance of the breaker becomes 0 Ω when the breaker is made and infinite when the breaker is broken, the make/break state of the breaker can be readily detected.

Also, since the breaker is connected with the breaker failure detecting device through the serge voltage preventing means for preventing the serge voltage generated in the secondary coil, the influence on the breaker failure detecting device can be prevented, and the abnormal state of the make/break operation of the breaker can be detected without damaging the break failure detecting device.

Also, according to a third aspect of the present invention, the crank angle detecting portion is so structured as to output an electric signal of a high level while the crank moves from a predetermined angular position before a compression top dead center to the top dead center and output an electric signal of a low level while the crank moves from the top dead center to the predetermined angular position before the top dead center, and there is further provided a waveform shaping means for waveform-shaping the electric signal of the high level into a waveform shaping signal representing the predetermined angular position before the top dead center and a waveform shaping signal representing the top dead center.

The spark plug disposed in the piston cylinder is so structured as to fire the air-fuel mixture within the piston cylinder by conducting spark discharge at the predetermined angular position of the crank before the piston reaches the top dead center. Accordingly, in the third aspect of the present invention, in order to judge whether or not the breaker is normally actuated, the electric signal of the high level corresponding to a position of the predetermined angular position before the top dead center of the crank to the top dead center is waveform-shaped and used as information of detecting the breaker make/break abnormality detection.

Further, according to a fourth aspect of the present invention, the breaker make/break abnormality detecting portion compares the waveform shaping signal outputted from the crank angle detecting portion and representing the predetermined angular position before the top dead center with a terminal portion of the electric signal outputted from the breaker make/break state detecting portion and representing the make state, and compares the electric signal outputted from the crank angle detecting portion and representing the top dead center, with the signal outputted from the breaker make/break state detecting portion and representing the break state.

Since the firing apparatus is so structured as to conduct the firing at the predetermined angular position of the top dead center (BTDC) of the crank shaft of the engine, it is necessary that the breaker is appropriately broken when the crank shaft reaches the angular position.

Accordingly, in the second, third and fourth aspects of the present invention, a slight error in the timing of the actual make/break operation of the breaker is estimated, the information of from an angular position slightly lower than the angular position of the crank shaft when firing to the top dead center (TDC) which is predetermined to the engine is grasped by the electric signal of a high level, and similarly information as to the make/break operation of the breaker is grasped by the electric signals of the high level and the low level, and those electric signals are compared with each other to detect the breaker make/break abnormality.

Accordingly, the breaker make/break abnormality detecting portion compares the electric signal representing the predetermined angular position before the top dead center outputted from the crank angle detecting portion, with the terminal portion of the electric signal outputted from the breaker make/break state detecting portion and representing the make state, and judges that the make operation of the breaker is appropriately conducted if the electric signal representing the make state of the breaker is inputted when the electric signal representing the predetermined angular position before the top dead center is inputted. Also, the breaker make/break abnormality detecting portion compares the electric signal outputted from the crank angle detecting portion and representing the top dead center, with the electric signal outputted from the breaker make/break state detecting portion and representing the break state, and judges that the break operation of the breaker is appropriately conducted if the electric signal representing the break state of the breaker is inputted when the electric signal representing the top dead center is inputted.

According to a fifth aspect of the present invention, the bridge circuit comprises a diode bridge circuit, and the serge voltage preventing means comprises a diode. Also, according to a sixth aspect of the present invention, the predetermined angle before the top dead center is 40 degrees. Since the engine for the aircraft is generally so structured as to fire at an angular position of 20 to 26 degrees before the top dead center, when it is judged whether or not the breaker is normally actuated, a reference position for detecting the breaker make state is provided at the angular position near 40 degrees before the top dead center which is before 20 degrees before the top dead center.

In addition, according to a seventh aspect of the present invention, the breaker make/break abnormality detecting portion comprises a flip-flop circuit.

BRIEF DESCRIPTION OF THE DRAWINGS

FIGS. 2 and 3 are diagrams showing directions of a current that flows in a circuit in a state where the bridge circuit is disposed between the ignition coil and the breaker, in which FIG. 2 shows a flow of the current in a plus direction and FIG. 3 shows a flow of the current in a minus direction;

DETAILED DESCRIPTION OF THE PREFERRED EMBODIMENTS

Hereinafter, a description will be predetermined in more detail of a magneto-system firing apparatus in accordance with an embodiment of the present invention with reference to the accompanying drawings.

Figure 1:
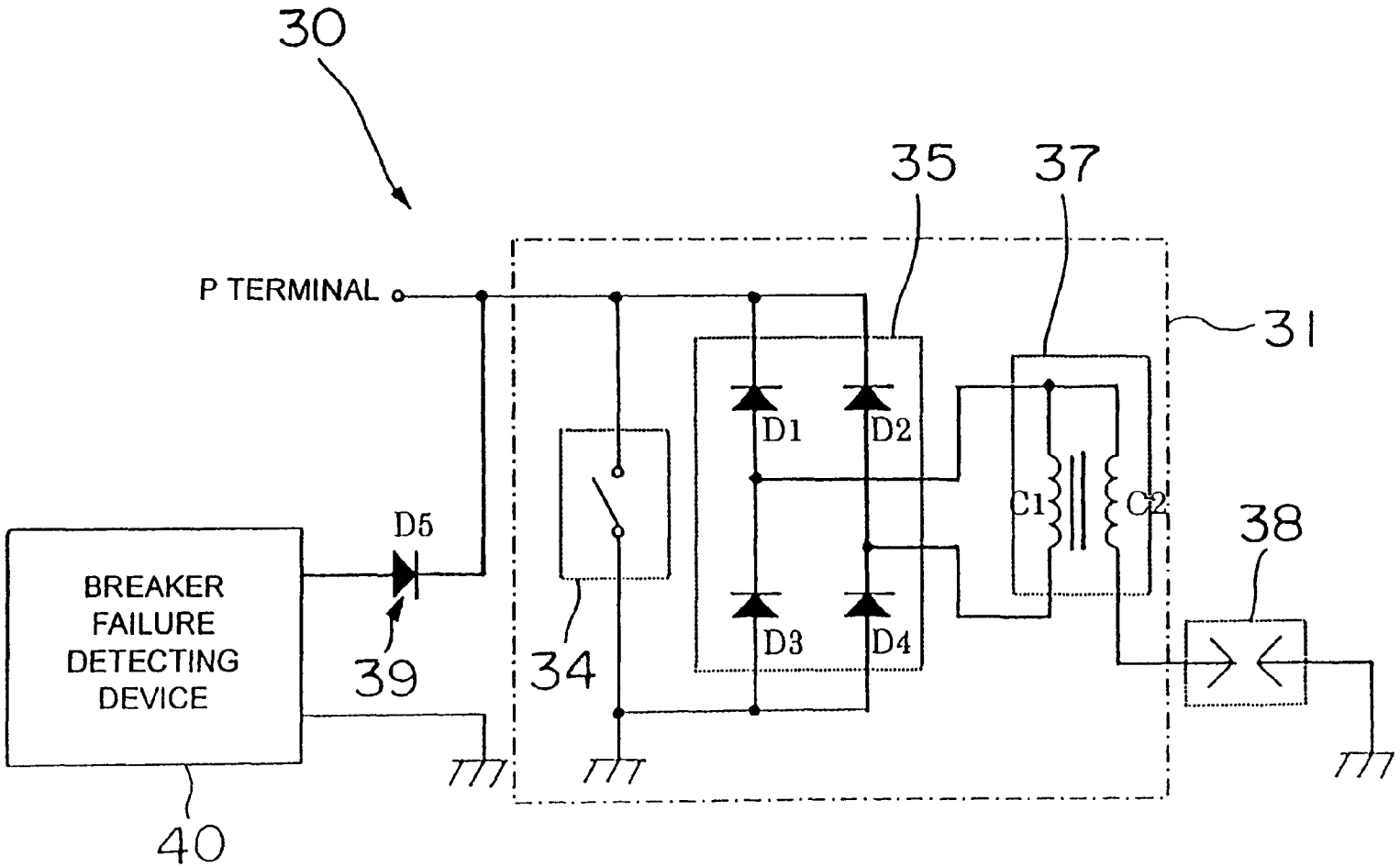
FIG. 1 is a conceptual diagram showing a magneto-system firing apparatus in accordance with the present invention, and a diagram showing a state in which a bridge circuit is connected and disposed between an ignition coil and a breaker, and the breaker is connected with a breaker failure detecting device through a serge voltage preventing means.

As shown in FIG. 1, in a magneto-system firing apparatus 30 according to this embodiment, a magneto-system firing apparatus main body 31 is connected with a breaker failure detecting device 40.

In this embodiment, a diode bridge circuit 35 is connected between a primary coil C1 that constitutes an ignition coil 37 and a breaker 34. Also, the breaker 34 is connected with a breaker failure detecting device 40 through a serge voltage preventing means 39 formed of a diode D5 that can prevent a serge voltage generated in the primary coil C1. In the figure, reference numeral 38 denotes a spark plug.

The diode bridge circuit 35 is made up of diodes D1 to D4 which are arranged as shown in FIG. 1. In general, since an electric power is generated by a magneto and an a.c. flows in the ignition coil 37, in the conventional magneto, an a.c. that flows in bi-directions of the coil flows, and the a.c. flows in the breaker 34 as the bi-directional current, likewise.

However, in this embodiment, since the diode bridge circuit 35 is provided, the a.c. that flows in the ignition coil 37 is rectified and converted into a one-way current. As a result, in this embodiment, a direction of the current that flows in the breaker 34 is always kept constant.

Figure 2:
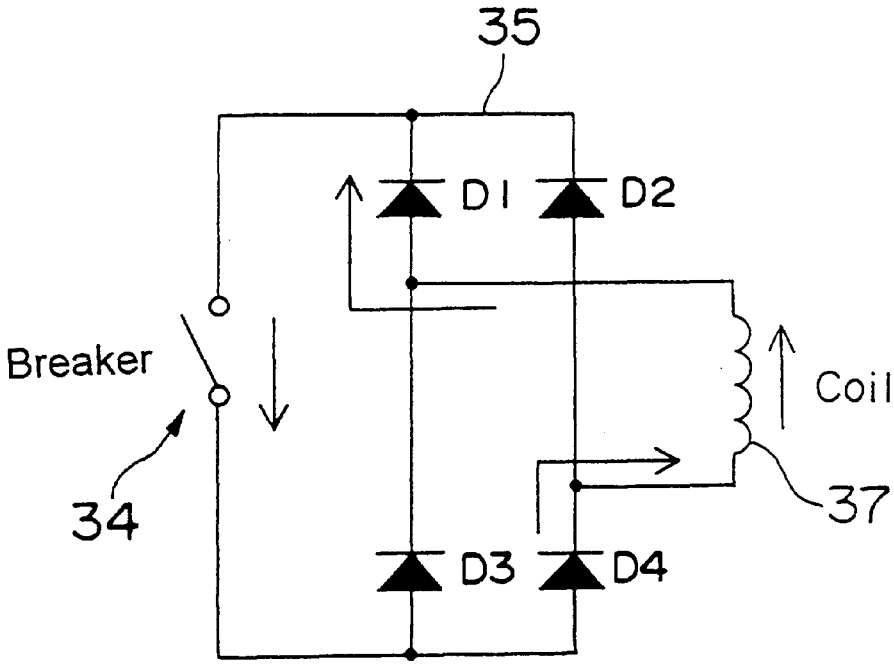
Figure 3:
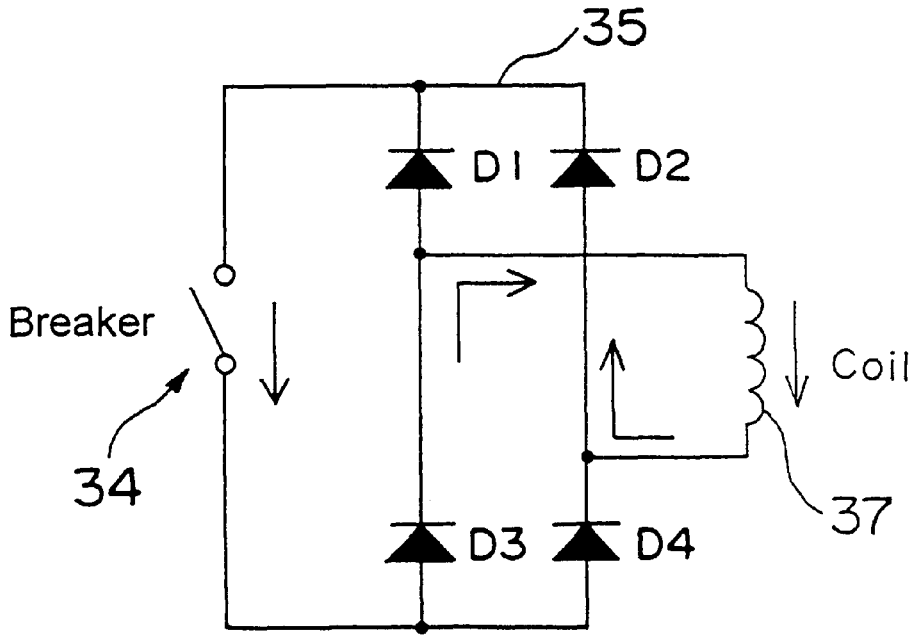

That is, as shown in FIGS. 2 and 3, assuming that a direction of the current that flows upstream is a plus side and a direction of the current that flows downstream is a minus side with respect to the ignition coil 37, FIG. 2 shows a case where a current of the plus direction flows in the ignition coil 37 as shown in the figure, and after a current flow passes through the diode D1 and the breaker 34, the current flow passes through the diode D4 and returns to the ignition coil 37.

Also, as shown in FIG. 3, a current flow in the case where the current of the minus direction flows in the coil, after the current flow passes through the diode D2 and the breaker 34, the current flow passes through the diode D3 and returns to the ignition coil 37. The diodes D1 to D4 to be used in the diode bridge circuit 35 can withstand the serge voltage generated in the ignition coil 37 when the current that flows in the ignition coil 37 is broken by the breaker 34.

Accordingly, in this embodiment, in detecting the failure of the breaker 34, in the case where a resistance when the breaker 34 is made and broken is measured to detect the make/break state of the breaker 34, because an influence of the impedance of the primary coil C1 connected in parallel with the breaker 34 is intercepted by the diode bridge circuit 35, the resistance is 0 Ω when the breaker is made and infinite when the breaker is broken, thereby being capable of clearly judging the make and break states of the breaker 34.

Up to now, since the bi-directional current flows in the breaker 34 as an a.c., both contact portions at the contact point are burned and damaged. However, in this embodiment, since the diode bridge circuit 35 is provided to rectify the current into a d.c., only one contact portion is burned and damaged. Therefore, a material of the contact portion at the contact point is easily selected.

Also, as shown in FIG. 1, since the breaker failure detecting device 40 is connected to the breaker 34 through the serge voltage preventing means 39, an influence of the serge voltage generated in the secondary coil C2 on the breaker failure detecting device 40 when the breaker 34 is broken can be removed, and the breaker failure detecting device 40 is not damaged by the serge voltage or the like. As a result, the magneto-system firing apparatus 30 according to this embodiment can be connected with an electronic parts or a circuit or the like for detecting the resistance value of the breaker.

Figure 4:
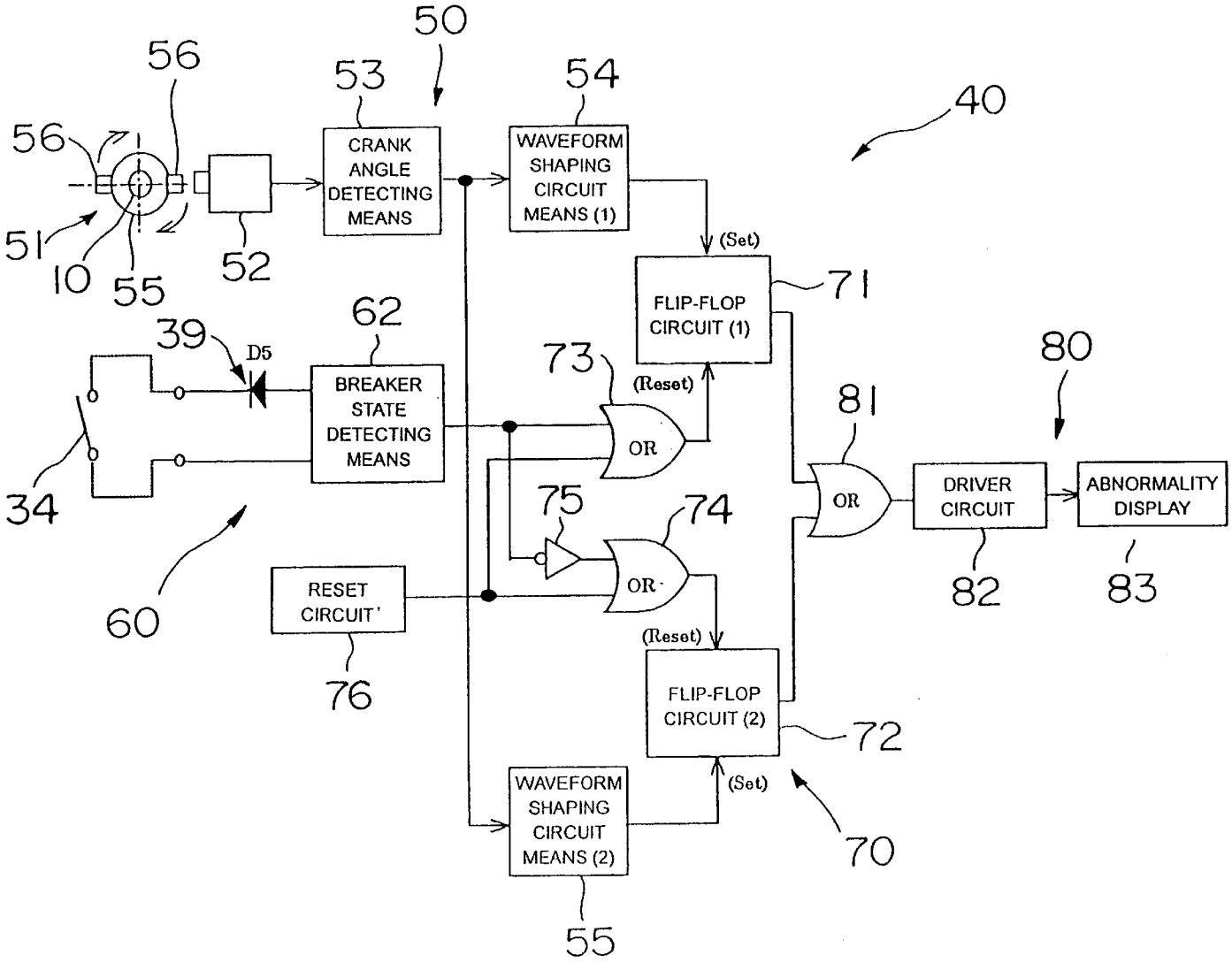
FIG. 4 is a diagram showing a breaker failure detecting device in a magneto-system firing apparatus in accordance with an embodiment of the present invention.

Then, as shown in FIG. 4, the breaker failure detecting device 40 used in the magneto-system firing apparatus 30 according to this embodiment includes a crank angle detecting portion 50 for detecting the rotating angle of the crank shaft, a breaker make/break state detecting portion 60 for detecting the make/break state of the breaker, a breaker make/break abnormality detecting portion 70 for detecting the abnormal state of the breaker make/break operation on the basis of information from the crank angle detecting portion 50 and the breaker make/break state detecting portion 60, and a display portion 80 for displaying the abnormal state detected by the breaker make/break abnormality detecting portion 70.

In this embodiment, the breaker failure detecting device 40 is structured by an electric circuit, but may be structured by a digital circuit using a microcomputer without any problem.

The crank angle detecting portion 50 includes a magnetic portion 51 disposed within the magneto and disposed on a rotary shaft 10 that interlocks with the crank shaft of the engine, a sensor 52 for detecting the magnetic portion 51, a crank angle detecting means 53 that outputs an electric signal resulting from detecting the magnetic portion 51 by the sensor 52 as an electric signal representing a crank angle, and waveform shaping means 54 and 55 that shape the waveform of an electric signal outputted from the crank angle detecting means 53.

The spark plug disposed in a cylinder conducts spark discharge at a predetermined angular position of the crank before a piston reaches a top dead center, to thereby fire an air-fuel mixture within the cylinder. Therefore, in the present invention, in order to judge whether or not the breaker 34 is normally actuated, an electric signal of high level corresponding to a position between a position of the predetermined angle before the top dead center of the crank and the top dead center is waveform-shaped and used as a basic information of detection of the breaker make/break abnormality.

As described above, in an engine for an aircraft, the spark plug is structured so as to be fired when the crank reaches a position of 20 degrees before the top dead center (TDC). Therefore, in order to decide that the firing system is appropriately actuated in the engine for the aircraft, it is necessary that in the case where the crank reaches the crank angle of 20 degrees of the top dead center (TDC), the breaker 34 is normally broken, and a high-voltage current is induced in the secondary coil. Therefore, in this embodiment, in detecting whether or not the breaker 34 is normally actuated, it is judged whether or not the breaker 34 is made at the angular position of 40 degrees of the top dead center (TDC) before 20 degrees before the top dead center, and when the crank reaches the top dead center (TDC), it is judged whether or not the breaker 34 is broken, to thereby judge the presence/absence of the make/break abnormality of the breaker 34.

The magnetic portion 51 is formed of a pair of magnetic blades 56, 56 on the peripheral edge portion of a rotor 55 disposed on the rotary shaft 10, and a sensor 52 for detecting the magnetic blades 56 is disposed in the vicinity of the rotary shaft 10. The sensor 52 may be used a general electromagnetic pickup, a magnetic resistant element, or the like.

Therefore, the rotary shaft 10 disposed within the magneto rotates in accordance with the rotation of the crank shaft, and when the sensor 52 detects the passing of the magnetic blades 56, 56, the sensor 52 outputs a predetermined electric signal to the crank angle detecting means 53. The crank angle detecting means 53 has information related to a relationship between the crank angle and the number of revolutions of the rotary shaft 10 in advance, and outputs the crank angle at that time as an electric signal at a timing for each of cylinders with reference to the above information.

The rotary shaft 10 of the magneto is driven by the engine through a drive gear. For example, in case of a four-cylinder engine, the drive gear of 1:1 is used so that the number of revolutions of the engine and the number of revolutions the rotary shaft 10 of the magneto become identical with each other. As usual, the four-cylinder engine conducts firing twice when the crank shaft rotates one revolution. Accordingly, the make/break operation of the breaker is also conducted twice.

Figure 5:
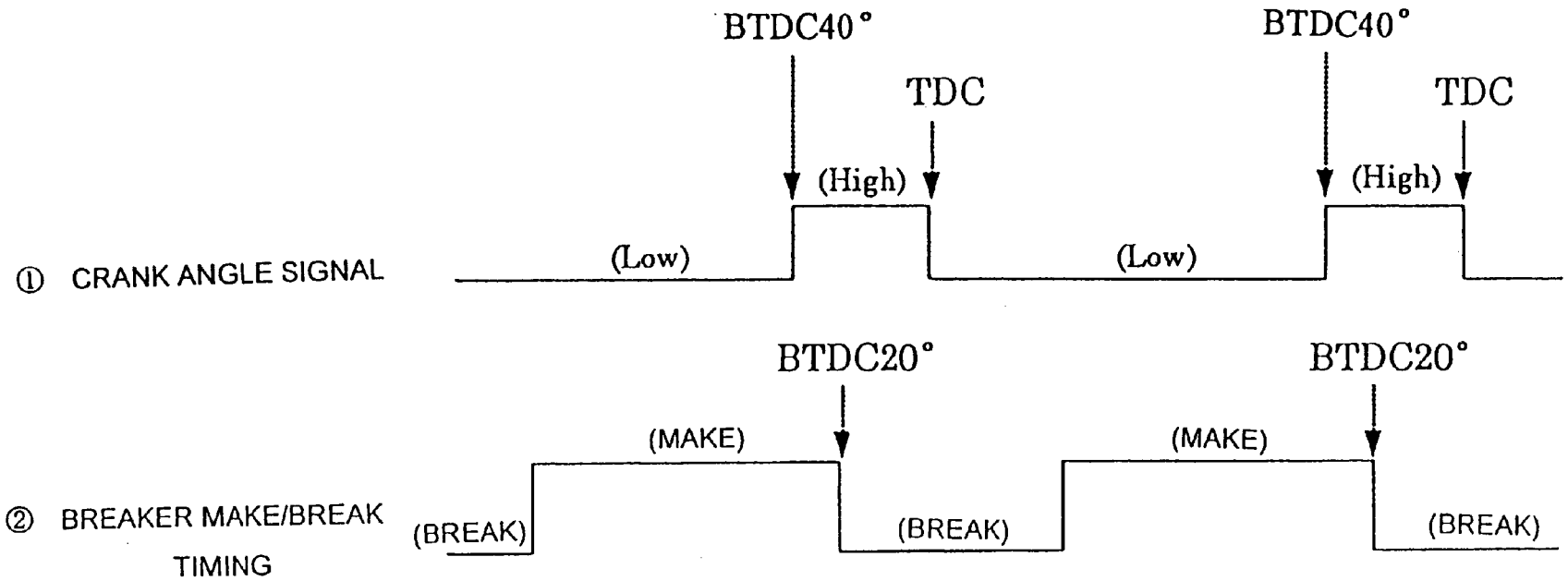
FIG. 5 is a diagram showing a crank angle signal detected by a crank angle detecting portion and a breaker make/break state signal detected by a breaker make/break state detecting portion corresponding to the crank angle signal, in which the crank angle signal outputs a signal of high level while a crank shaft reaches from 40 degrees before a top dead center (BTDC) to the top dead center (TDC), and the breaker make/break state signal outputs a signal of high level in a make state.

FIG. 5 shows the crank angle signal and the breaker make/break timing corresponding to the crank angle signal while the crank of the four-cylinder engine rotates one revolution in a magneto-system firing apparatus of this embodiment. As shown in FIG. 5, the crank angle detecting means 53 is structured so as to output the electric signal of high level while the crank moves from a position of 40 degrees before the top dead center (BTDC) to the top dead center (TDC), and output the electric signal of low level while the crank moves from the top dead center (TDC) to the position of 40 degrees before the top dead center (BTDC).

Also, after the crank angle signal representing the crank angle is outputted from the crank angle detecting portion 50, is inputted to said waveform shaping means 54 and 55, and waveform-shaped.

That is, as shown in FIG. 4, the crank angle detecting means 53 are connected to the two waveform shaping means 54 and 55. The waveform shaping means 54 waveform-shapes the electric signal of high level representing that the crank is positioned in while the crank reaches the top dead center (TDC) from the position of 40 degrees before the top dead center (BTDC) into the electric signal representative of the position of 40 degrees before the top dead center, and the waveform shaping means 55 waveform-shapes the electric signal representing the top dead center. As a result, the waveform shaping means 54 outputs a waveform shaping signal (1) as the crank angle signal of high level corresponding to the position of the crank shaft that is 40 degrees before the top dead center (BTDC), and the waveform shaping means 55 outputs a waveform shaping signal (2) as the crank angle signal of high level corresponding to the position of the crank shaft that is the top dead center (TDC). Those waveform shaping signals (1) and (2) are inputted to the breaker make/break abnormality detecting means 71 and 72 that constitute a breaker make/break abnormality detecting portion 70 which will be described later, respectively.

As shown in FIG. 4, the breaker 34 is connected with a breaker state detecting means 62 that constitutes the breaker make/break state detecting portion 60 through the diode D5 as the serge voltage preventing means. As shown in FIG. 5, the breaker state detecting means 62 outputs an electric signal representing the make/break state of the breaker.

FIG. 5 shows the make/break timing of the breaker 34 with reference to the crank angle, and the signal of high level is outputted in case of the make state and the signal of low level is outputted in case of the break state, responding to the breaker make/break timing respectively. In this embodiment, an example where the breaker 34 comes to the break state from the make state at 20 degrees before the top dead center (BTDC) is explained.

Subsequently, the detection of the breaker make/break state will be described in the structure where the diode bridge circuit 35 is disposed between the breaker 34 and the ignition coil 37.

Figure 6:
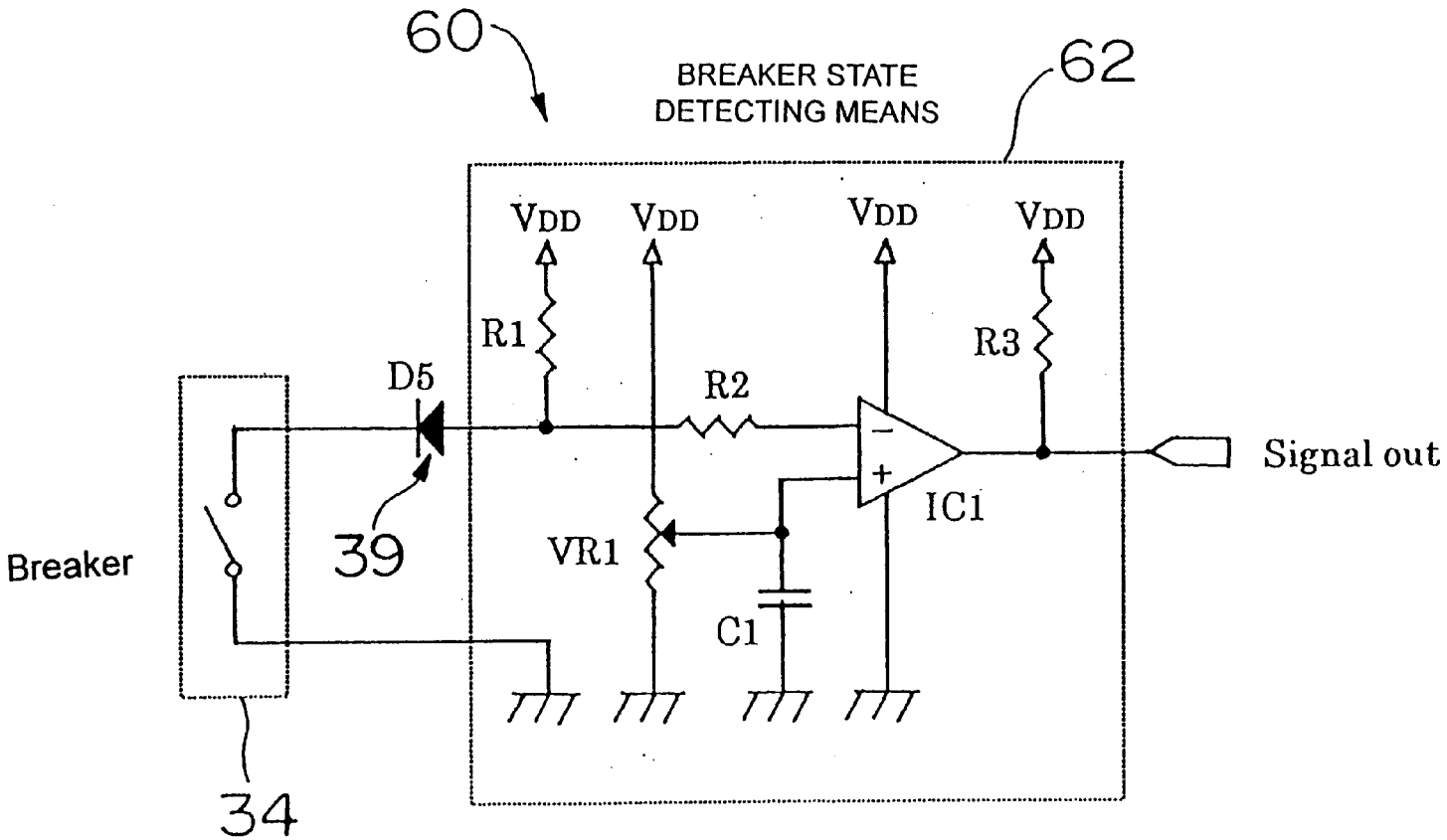
FIG. 6 is a diagram showing the structure of a breaker make/break state detecting means in accordance with an embodiment of the present invention.

In this embodiment, the breaker make/break state detecting portion 60 has a breaker state detecting means 62 formed of a circuit, and FIG. 6 shows an embodiment of the detecting circuit.

As shown in FIG. 6, the breaker state detecting means 62 is connected to the breaker 34 through the diode D5, and the diode D5 is provided so as to prevent a reverse voltage for preventing the influence of the serge voltage generated in the secondary coil C2 on the detecting circuit side when the breaker 34 conducts the make/break operation.

In addition, a control power supply VDD of the detecting circuit is connected to an anode side of the diode D5 through a resistor R1, and further a cathode side of the diode D5 is connected to one end of the breaker. Also, the other end of the breaker 34 is connected to the GND side of the control power supply within the detecting circuit.

On the other hand, the anode side of the diode D5 is further connected to the minus side input terminal of an IC1 which is a voltage comparator through a resistor R2. Also, the plus side input terminal of the IC1 is connected to a neutral point of the variable resistor VR1. One end of the fixed resistor portion of the variable resistor VR1 is connected to the control power supply VDD of the detecting circuit, and the other end of the fixed resistor portion is connected to GND of the control power supply. A capacitor C1 is further connected to the neutral point portion of the variable resistor VR1 so as to stabilize the set voltage at the variable resistor VR1 portion.

The breaker make/break state detecting portion 60 thus structured operates as follows:

First, a case in which the breaker 34 is in the break state will be described. In the case where the breaker 34 is in the break state, since the detecting circuit is disconnected from the breaker 34, no current flows into the breaker 34 from the detecting circuit, and a potential at the anode side of the diode D5 becomes equal to the control supply voltage VDD, and a value resulting from dividing the control power supply voltage is applied to the plus side input terminal of the voltage comparator IC1 by the variable resistor VR1. The voltage at the plus side input terminal becomes about ½ of the control power supply voltage. The voltage comparator IC1 compares the potential at the plus side input terminal with the potential at the minus side input terminal, and outputs a voltage corresponding to mark [(+) or (−)] which is larger in potential. Therefore, in the case where the breaker is in the break state, because the potential at the minus side input terminal becomes VDD that is larger than VDD/2 which is the potential at the plus side input terminal, the voltage comparator outputs the voltage of the control power supply voltage GND level. Also, in the case where the breaker 34 is in the make state, the diode D5 is short-circuited to GND which is the control power supply voltage of the detecting circuit. As a result, the potential at the anode side of the diode D5 becomes GND level of the control power supply voltage. In this case, strictly speaking, the potential at the anode side of the diode D5 is higher than the GND level by the forward direction voltage drop of the diode, about 0.7 V. In FIG. 6, the resistor R1 is so designed as to limit a current that flows from the control power supply when the breaker 34 becomes in the make state and is determined in accordance with a current value that breaks an oxide film on the breaker 34.

Accordingly, in the case where the breaker 34 is in the make state, a voltage of about 0.7 V is applied to the minus side input terminal of the voltage comparator IC1. On the other hand, a voltage of about ½ of the control power supply voltage is applied to the plus side input terminal of the voltage comparator IC1. However, since a power supply of 15 V is normally used for the control power supply voltage, that value becomes about 7.5 V. Therefore, in the case where the breaker is in the make state, since the plus side input terminal side is larger in the voltage at the input terminal of the voltage comparator IC1 than the minus side, the voltage comparator IC1 outputs the control power supply voltage VDD.

As a result, as shown in FIG. 5, the breaker make/break state detecting portion 60 outputs the breaker make/break state signal of high level in the case where the breaker is in the make state by the make/break timing of the breaker 34, and outputs the breaker make/break state signal of low level in the case where the breaker 34 is in the break state. Those breaker make/break state signals are inputted to a breaker make/break abnormality detecting means 71 and 72 which will be described later.

Subsequently, the breaker make/break abnormality detecting portion 70 will be described. The breaker make/break abnormality detecting portion 70 comprises two breaker make/break abnormality detecting means 71 and 72, OR circuits 73 and 74 connected to the respective breaker make/break abnormality detecting means 71 and 72, and an inverter circuit 75 for inverting the breaker make/break state detecting signal outputted from the breaker make/break state detecting portion 60.

In this embodiment, the above two breaker make/break abnormality detecting means 71 and 72 are made up of a flip-flop circuit, respectively. The breaker make/break abnormality detecting means 71 detects the abnormality of the breaker 34 in the make state, and the breaker make/break abnormality detecting means 72 detects the abnormality of the breaker 34 in the break state.

As shown in FIG. 4, the SET terminal of the breaker make/break abnormality detecting means 71 that detects the abnormality when the breaker is in the make state is connected to one waveform shaping means 54 that constitutes the crank angle detecting portion 50, and the RESET terminal of the breaker make/break abnormality detecting means 71 is connected to one OR circuit 73.

On the other hand, the SET terminal of the breaker make/break abnormality detecting means 72 that detects the abnormality when the breaker is in the break state is connected to the other waveform shaping means 55 that constitutes the crank angle detecting portion 50, and the RESET terminal of the breaker make/break abnormality detecting means 72 is connected to the other OR circuit 74.

Figure 7:
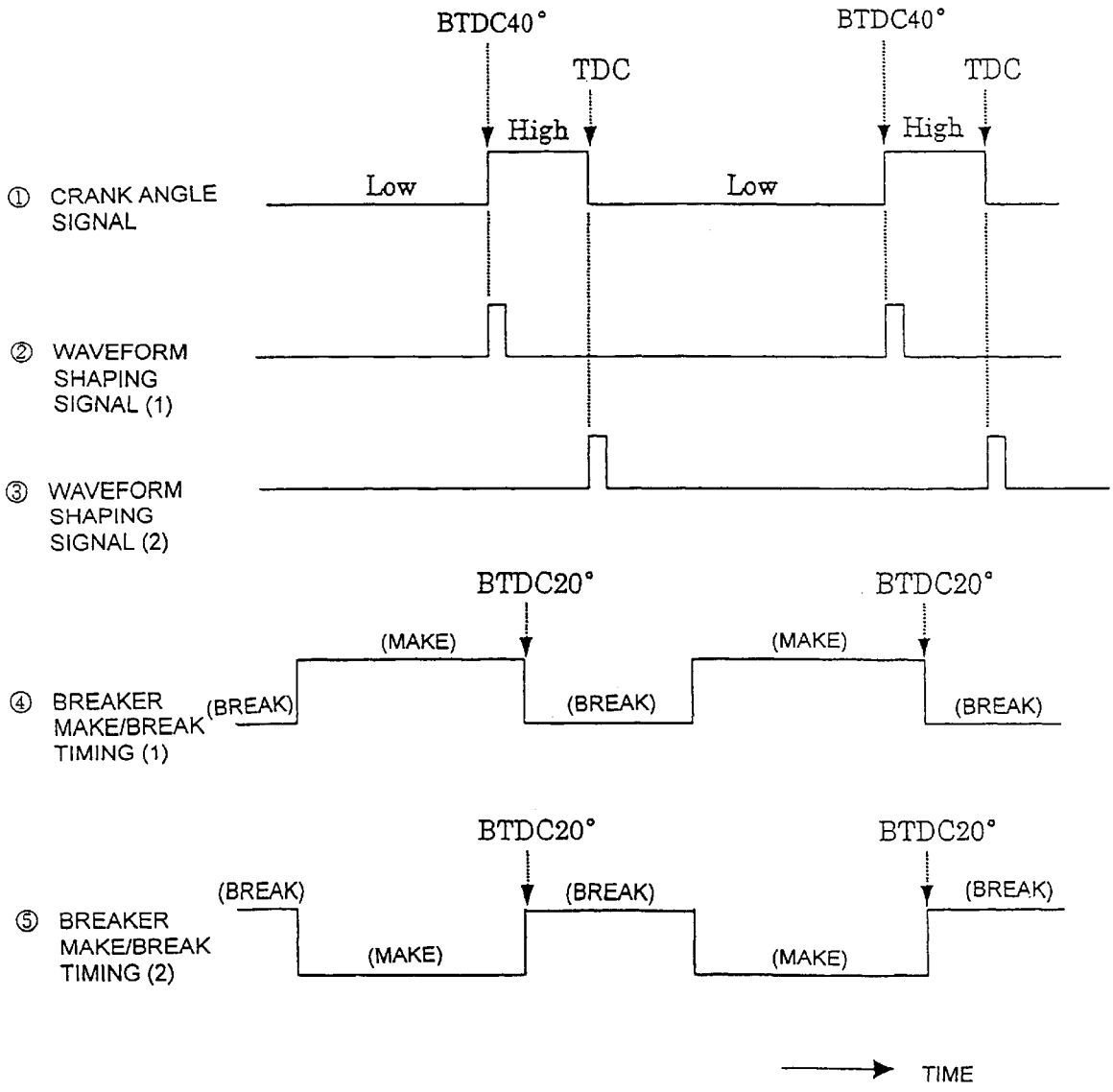
FIG. 7 is a diagram showing a crank angle signal detected by a crank angle detecting portion and a breaker make/break state signal detected by a breaker make/break state detecting portion corresponding to the crank angle signal, and also a diagram showing a crank angle signal waveform shaped by a waveform shaping means and representing a crank angle signal outputting a signal of high level at 40 degrees before the top dead center (BTDC) and the top dead center (TDC), a breaker make/break state signal outputted from the breaker make/break state detecting portion and a signal resulting from inverting the breaker make/break state signal.
Figure 8:
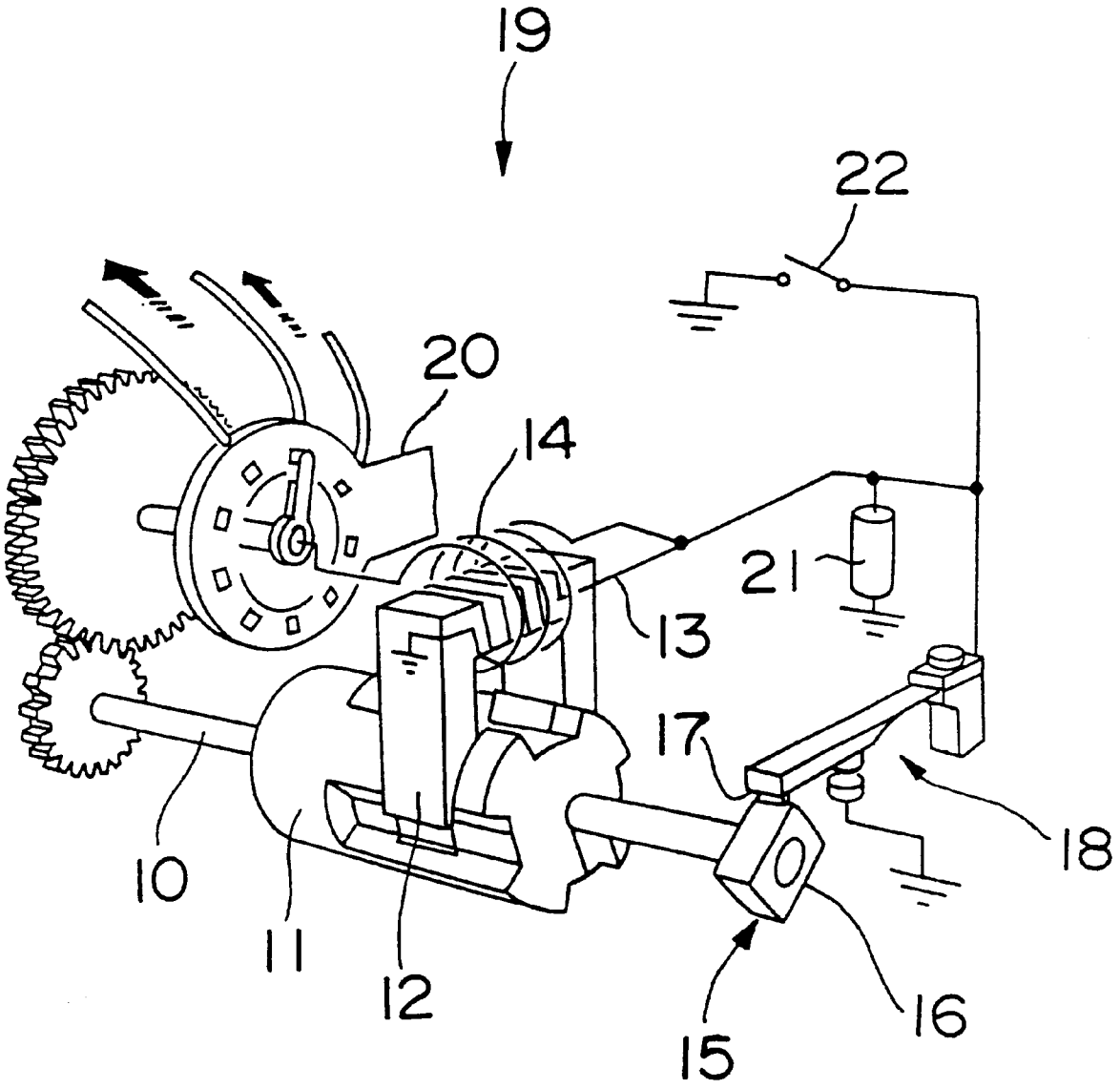
FIG. 8 is a conceptual diagram showing the general structure of a magneto.

The above OR circuits 73 and 74 are connected to the breaker make/break state detecting means 62 that constitutes the breaker make/break state detecting portion 60. In this case, one input terminal of the other OR circuit 74 is connected with an inverter circuit 75. As shown in FIG. 7, the inverter circuit 75 is used to partially invert a breaker make/break state detection signal outputted from the breaker make/break state detecting portion 60.

That is, in order that the electric signal corresponding to before the top dead center (BTDC) outputted from the waveform shaping means 55 of the crank angle detecting portion 50 and the breaker make/break state detection signal are compared with each other using the flip-flop circuit to detect the make/break abnormality, the breaker make/break state signal outputted from the breaker make/break state detecting means 62 maybe used as it is. However, in order that the electric signal corresponding to the top dead center (TDC) and the breaker make/break state detection signal are compared with each other using the flip-flop circuit to detect the make/break abnormality, the breaker make/break state signal needs to be inverted.

Also, one input terminals of each of the OR circuits 73 and 74 are connected with a reset circuit 76 respectively. The reset circuit 76 is provided so as to accurately detect the state of the breaker 34. The reset circuit 76 has a function of suspending the operation of the detecting circuit so that the detecting circuit does not malfunction in the case where the number of revolutions of the engine is equal to or smaller than a predetermined number of revolutions, and outputs a signal of high level at the time where the detecting circuit is operative and outputs a signal of low level at the time where the detecting circuit is inoperative.

Hereinafter, the operation of the breaker make/break abnormality detecting means 71 and 72 will be described.

As described above, the crank angle signal representative of 40 degrees before the top dead center (BTDC) detected by the crank angle detecting means 53 that constitutes the crank angle detecting portion 50 and is waveform-shaped by the waveform shaping means 54 is inputted to the SET terminal of the breaker make/break abnormality detecting means 71 which is a flip-flop circuit. On the other hand, the breaker make/break state signal outputted from the breaker make/break state detecting means 62 is inputted to the RESET terminal of the breaker make/break abnormality detecting means 71 through the OR circuit 73.

The flip-flop circuit operates so as to give priority to the high level signal when a signal of high level is inputted to the RESET terminal and even if any signal is inputted to the SET terminal of the flip-flop circuit, the flip-flop circuit forcedly makes its output as low level. Also, when a signal of high level is inputted to the SET terminal after the reset terminal of the flip-flop circuit becomes low level, the flip-flop circuit retains the high level output until a signal of high level is inputted to the RESET terminal again.

In the magneto-system firing apparatus 30 according to this embodiment, as described above, the breaker 34 is structured so as to shift from the make state to the break state at 20 degrees before the top dead center (BTDC), and as shown in FIG. 7, in the case where the breaker 34 conducts normally the make/break operation, it is necessary that the breaker 34 becomes in the make state when the crank angle is 40 degrees before the top dead center (BTDC).

Accordingly, in the case where the breaker make state signal is inputted to the RESET side terminal of the breaker make/break abnormality detecting means 71 formed of a flip-flop circuit, and the crank angle signal is inputted to the SET terminal, the breaker make/break detecting means 71 gives priority to the input at the RESET terminal side regardless of an input to the SET terminal because the breaker make state signal which is an input of the RESET side terminal is high level, and the breaker make/break abnormality detecting means 71 outputs a signal of low level.

As a result, the breaker make/break abnormality detecting means 71 that detects the abnormality when the breaker is in the make state, outputs a signal of low level in the case where the (breaker 34 normally conducts the make operation.

On the other hand, in the case where the breaker 34 normally conducts the make/break operation, when the crank angle becomes the top dead center (TDC), firing in the plug has been already made as a result of which it is necessary that the breaker 34 becomes in the break state, and the break state of the breaker 34 is detected by the breaker make/break abnormality detecting means 72.

In this case, since the breaker make/break state detecting means signal outputted from the breaker make/break state detecting means 62 is inputted to the breaker make/break abnormality detecting means 72 through the inverter circuit 75 as shown in FIG. 7, the inverted breaker make/break state signal is inverted in level as compared with the breaker make/break state signal which is not yet inverted. In the case where the breaker 34 is in the make state, the breaker make/break state signal is inputted as the low level to the breaker make/break abnormality detecting means 72 whereas in the case where the breaker 34 is in the break state, the breaker make/break state signal is inputted as the high level to the breaker make/break abnormality detecting means 72.

Accordingly, in the case where the breaker make/break state signal is inputted to the RESET side terminal of the breaker make/break abnormality detecting means 72 formed of a flip-flop circuit, and the crank angle signal is inputted to the SET terminal, the breaker make/break detecting means 72 gives priority to the input at the RESET terminal side regardless of an input to the SET terminal when the breaker break state signal which is an input of the RESET side terminal is high level, and the breaker make/break abnormality detecting means 72 outputs a signal of low level.

As a result, the breaker make/break abnormality detecting means 72 that detects the abnormality when the breaker is in the break state, outputs a signal of low level as in the case of the detection of the make state from the breaker make/break abnormality detecting means 72 in the case where the breaker 34 normally conducts the break operation.

Subsequently, in the breaker make/break abnormality detecting means 71 and 72, a state where the breaker 34 does not normally conducts the make/break operation will be described.

As a case where the operation of the breaker 34 is abnormal, for example, there are assumed a case where the breaker 34 is in the break state at the time the crank angle is of 40 degrees before the top dead center (BTDC), and a case where the breaker 34 is in the make state when the crank angle is positioned at the top dead center (TDC).

For example, in the case where the breaker 34 is in the break state at the time of 40 degrees before the top dead center (BTDC), the crank angle signal of low level which is in the break state is inputted to the RESET terminal of the breaker make/break abnormality detecting means 71. A signal of high level which is a crank angle signal is inputted to the SET terminal, and since the flip-flop circuit retains the high level output until the signal of high level is inputted to the RESET terminal again, the breaker make/break abnormality detecting means 71 outputs the signal of high level.

Also, similarly, in the case where the breaker 34 is in the make state when the crank angle is positioned at the top dead center (TDC), a signal representative of the breaker make/break state which is inputted to the RESET side terminal of the breaker make/break abnormality detecting means 72 becomes a signal of low level representative of the make state which is inverted by the inverter circuit 75. Therefore, a signal of high level is outputted from the breaker make/break abnormality detecting means 72 as in the above.

Accordingly, in the case where the abnormality of the make/break operation of the breaker is detected, the signal of high level is outputted from the breaker make/break abnormality detecting means 71 and 72.

Then, in this embodiment, there is provided an abnormality display portion 80 that displays the abnormal state detected by the breaker make/break abnormality detecting portion 70.

The abnormality display portion 80 comprises an OR circuit 81 connected to the breaker make/break abnormality detecting means 71 and 72, a driver circuit 82 connected to the OR circuit 81 and a display means 83 connected to the driver circuit 82.

Accordingly, in the case where abnormality occurs in the make/break operation of the breaker 34, and a signal of high level is outputted from any one of the breaker make/break abnormality detecting means 71 and 72, the signal of high level is current-amplified in the driver circuit 82 through the OR circuit 81, and thereafter the display means 83 displays "breaker operation abnormality". The display means 83 is appropriately disposed in a cockpit of an aircraft, as a result of which a pilot or the like can recognize the abnormality of the make/break operation of the breaker 34 of the magneto-system firing apparatus 30 in a state where he sits on a seat.

In this embodiment, the description was predetermined of an example in which the magneto-system firing apparatus of the present invention is applied to the aircraft. However, the present invention is not limited to the above embodiment, but can be applied to an engine having a magneto-system firing apparatus mounted on a machine other than the aircraft. Also, the contents disclosed in the above specification is not limited to the above embodiment as long as they are not out of the subject matter recited in the following claims.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A magneto-system firing apparatus, comprising:

a magnet fixed to a rotary shaft that interlocks with a crank shaft of an engine; a primary coil to which a low-voltage current that is generated due to the rotation of said magnet is supplied; a breaker which is connected to said primary coil and interrupts the low-voltage current supplied to said primary coil by its break operation; a secondary coil in which a predetermined voltage is induced due to the current interruption caused by the break operation of said breaker to actuate the firing apparatus by application of the voltage generated in said secondary coil;

a crank angle detecting portion for detecting the rotating angle of said crank shaft; a breaker make/break state detecting portion for detecting the make/break state of said breaker; and a breaker failure detecting device having a breaker make/break abnormality detecting portion which is capable of detecting the abnormal state of the breaker make/break operation on the basis of information from said crank angle detecting portion and said breaker make/break state detecting portion.

2. A magneto-system firing apparatus as claimed in claim 1, wherein a bridge circuit is connected and arranged between said primary coil and said breaker, and said breaker is connected with said breaker failure detecting device through a serge voltage preventing means for preventing a serge voltage generated in said primary coil;

wherein said crank angle detecting portion comprises a magnetic portion disposed on said rotary shaft, a sensor that detects the magnetic portion, and a crank angle detecting means for outputting an electric signal resulting from detecting said magnetic portion by said sensor as an electric signal that represents the rotating angle of said crank; and wherein said breaker make/break state detecting portion is structured so as to output the make/break state of the breaker as an electric signal, and said breaker make/break abnormality detecting portion is structured so as to output a predetermined electric signal on the basis of the electric signals outputted from said crank angle detecting portion and said breaker make/break state detecting portion if an abnormality occurs in the make/break operation of the breaker.

3. A magneto-system firing apparatus as claimed in claim 2, wherein said crank angle detecting portion is structured so as to output an electric signal of a high level while said crank moves from a predetermined angular position before a compression top dead center to the top dead center and output an electric signal of a low level while said crank moves from the top dead center to the predetermined angular position before the top dead center, and there is further provided a waveform shaping means for waveform-shaping the electric signal of the high level into a waveform shaping signal representing the predetermined angular position before the top dead center and a waveform shaping signal representing the top dead center.

4. A magneto-system firing apparatus as claimed in claim 3, wherein the predetermined angle before the top dead center is 40 degrees.

5. A magneto-system firing apparatus as claimed in claim 2, wherein said breaker make/break abnormality detecting portion compares the waveform shaping signal outputted from said crank angle detecting portion and representing the predetermined angular position before the top dead center with a terminal portion of the electric signal outputted from said breaker make/break state detecting portion and representing the make state, and compares the electric signal outputted from said crank angle detecting portion and representing the top dead center with the signal outputted from said breaker make/break state detecting portion and representing the break state.

6. A magneto-system firing apparatus as claimed in claim 5, wherein the predetermined angle before the top dead center is 40 degrees.

7. A magneto-system firing apparatus as claimed in claim 5, wherein said breaker make/break abnormality detecting portion comprises a flip-flop circuit.

8. A magneto-system firing apparatus as claimed in claim 2, wherein said bridge circuit comprises a diode bridge circuit, and said serge voltage preventing means comprises a diode.

9. A magneto-system firing apparatus as claimed in claim 2, wherein said breaker make/break abnormality detecting portion comprises a flip-flop circuit.

10. A magneto-system firing apparatus as claimed in claim 1, wherein said breaker make/break abnormality detecting portion comprises a flip-flop circuit.

* * * * *